United States Patent [19]

Bruno

[11] 4,228,888

[45] Oct. 21, 1980

[54] APPARATUS FOR FEEDING ARTICLES SUCH AS SWEETMEAT PRODUCTS TO A PACKAGING MACHINE

[75] Inventor: C. Ludovico Bruno, Oundle, England

[73] Assignee: Alisyncro S.a.S. di Bruno & C., Leini, Italy

[21] Appl. No.: 959,387

[22] Filed: Nov. 9, 1978

[30] Foreign Application Priority Data

Nov. 15, 1977 [IT] Italy ..... 69573 A/77
Aug. 8, 1978 [IT] Italy ..... 68873 A/78

[51] Int. Cl.[3] ..... B65G 47/66; B65G 47/88

[52] U.S. Cl. ..... 198/461; 198/579; 198/600

[58] Field of Search ..... 198/425, 459, 461, 579, 198/600

[56] References Cited

U.S. PATENT DOCUMENTS

| | | | |
|---|---|---|---|
| 2,141,876 | 12/1938 | Perkins | 198/600 |
| 3,602,358 | 8/1971 | Jakobsson | 198/461 X |
| 3,661,243 | 5/1972 | Piatek | 198/449 X |
| 3,721,330 | 3/1973 | Crawford et al. | 198/461 |
| 3,923,142 | 12/1975 | Rysti | 198/461 |

*Primary Examiner*—Jeffrey V. Nase
*Attorney, Agent, or Firm*—Sughrue, Rothwell, Mion, Zinn and Macpeak

[57] ABSTRACT

Feeding apparatus comprising an elevator, with a general structure similar to that of an escalator, having shelves of size proportioned for receiving articles; the shelves move continuously along an ascending active run of the elevator between fixed lower and upper platforms; a feed belt feeds the articles onto the lower platform and ejection means operate in synchronism with the elevator to eject the articles from the upper platform and feed them to the packaging machine, spaced apart axially at intervals by a predetermined spacing.

5 Claims, 10 Drawing Figures

APPARATUS FOR FEEDING ARTICLES SUCH AS SWEETMEAT PRODUCTS TO A PACKAGING MACHINE

The present invention relates to apparatus for feeding articles such as sweetmeat products to packaging machines.

More particularly the invention concerns feeder apparatus for collecting articles from a manufacturing plant, lined up in longitudinal rows parallel to the feed direction, and feeding the said articles, in one or more longitudinal rows, to a downstream packaging machine, the articles in the or each row being axially spaced apart by a predetermined gap and delivered to a conveyor with which the packaging machine is provided.

Some known apparatus of this kind is of complicated construction, since means are needed for detecting the position of the articles; other apparatus has the disadvantage that the articles are subjected to collisions which are often injurious if the articles should be fragile, for example, as in the case of tablets or bars of chocolate, and chocolates.

An object of the present invention is to provide a feeder apparatus of the kind specified above, which will be able to function effectively regardless of the position of the articles in the apparatus, and which can moreover convey the said articles, even when they are fragile, without causing them damage.

According to the present invention there is provided a feeder apparatus for feeding articles such as sweetmeat products to a packaging machine, characterised in that the apparatus comprises in series:

(a) a continuously driven feed conveyor belt arranged to receive at least one longitudinal row of articles from production plant;

(b) an elevator having shelves movable continuously along a path which includes an ascending run and a descending run in the manner of an escalator, each shelf having a size corresponding to the size of the articles and having an upper comb-shaped support surface for the individual articles;

(c) a fixed lower platform adjacent and coplanar with the delivery end of the feed conveyor belt;

(d) an upper fixed platform, the said platforms having comb-like configurations staggered in relation to the comb-shaped surfaces of the shelves so that the latter pass through said platforms, each shelf of the ascending run of the elevator being displaceable from a lower, loading, position in which it is coplanar with the lower platform to an upper, delivery, position in which it is coplanar with the upper platform, and (e) ejecting means, operable in synchronism with the elevator, for the removal of the articles as these are delivered to the upper platform.

Thanks to this characteristic, the feeder apparatus is able to ensure a constant spacing between the articles of the or each longitudinal row (or between the successive transverse rows of articles belonging to side-by-side longitudinal rows) without recourse to complicated means, such as photoelectric means, for detecting the positions of articles.

Preferably, the ejection means comprise a continuously driven endless chain passing around two sprocket wheels, the operative run of said chain passing above, and parallel to, the upper platform, and the said chain being provided with at least one pallet extending in the operative run into the proximity of the upper platform.

This embodiment has the advantage that all the component members of the apparatus are continuously driven, so that the apparatus is able to effect high-speed feeding of articles, without the danger of these articles suffering such damaging collisions as would be inevitable with reciprocating feeder members operating at high speed.

According to another embodiment of the invention, the apparatus further includes pressure means arranged above the lower platform and adapted to keep each article on the surface of said lower platform before it is lifted by one of the moving shelves of the elevator.

This embodiment of the invention has the advantage of ensuring the correct position on the lower platform of each article before the latter is lifted by one of the moving elevator shelves.

Preferably, the said pressure means comprise a rotor, rotatable about an axis perpendicular to the longitudinal row of articles and driven by the feed belt, the said rotor being provided with at least one active peripheral portion which at its lowest point is spaced from the lower fixed platform by a distance substantially equal to the height of the articles fed over said platform.

The invention will now be further described, by way of non-limiting example, with reference to the accompanying drawings, in which.

Figure 1:
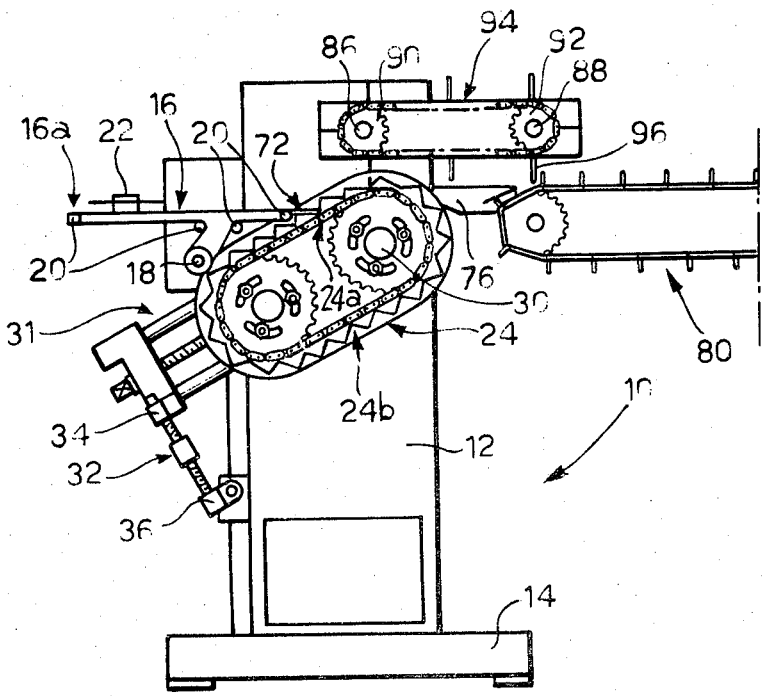
FIG. 1 is a diagrammatic side elevational view of a feeder apparatus according to one embodiment of the invention.

In the embodiment illustrated in FIGS. 1 to 6, reference numeral 10 indicates generally feeder apparatus for receiving from a production plant (not shown) products, such as sweetmeat articles 22, aligned in a longitudinal row parallel to the feed direction of a feed conveyor belt (not shown).

The apparatus 10 feeds the articles 22, spaced apart longitudinally by a predetermined spacing, to a packaging machine (not shown) having a chain conveyor which requires a constant supply of articles spaced apart by a predetermined spacing.

The feed apparatus 10 has a support structure 12 resting upon a base 14. The support structure 12 carries a feed conveyor belt 16 which passes around a drive roller 18 and four idle rollers 20. The drive roller 18 driven via a chain transmission, by a horizontal drive shaft 30 which is rotatably supported by the support structure 12. The drive shaft 30 is coupled to a drive output of the associated packaging machine, the shaft 30 driving all the moving parts of the apparatus 10, as will be described. The conveying run of the feed conveyor belt 16 is arranged horizontally with its load receiving end 16*a* disposed adjacent the delivery end of the belt (not shown) which feeds the longitudinal row of articles 22 arriving from the production plant.

The feed conveyor belt 16 is driven continuously, at a speed substantially equal to the feed speed of the conveyor which feeds the articles 22 to the conveyor belt 16.

An article elevator 24, having a general structure similar to that of an escalator, has an ascending run 24*a* and a descending return run 24*b*.

The elevator 24 is driven by an upper drive shaft 30 and has a lower idle shaft 28 rotatably supported by a frame 31 which is articulated to the support structure 12. The frame 31 is movable angularly about the axis of rotation of the drive shaft 30. Movement of the frame 31 is effected by rotation of a shaft 32 having opposite handed screw threaded ends 32*a*, 32*b*. The threaded ends 32*a* and 32*b* are screwed into correspondingly threaded bores in supports 34 and 36 which are pivotally connected to the frame 31 and to the support structure 12 respectively.

Figure 4:
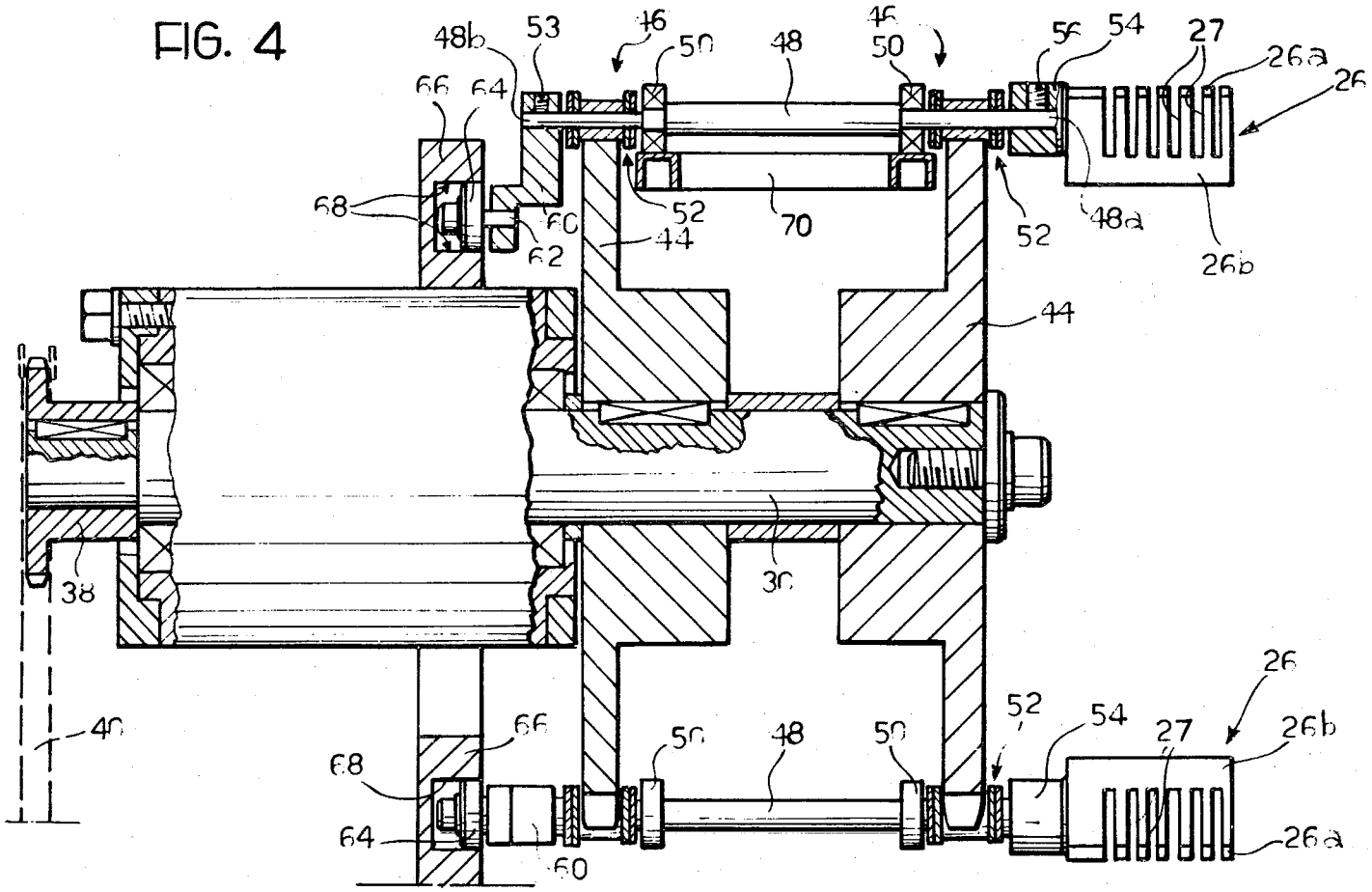
FIG. 4 is a cross section taken along the line IV—IV of FIG. 2.

As shown in FIG. 4, the drive shaft 30 of the elevator 24 is provided at one end with a sprocket wheel 38 around which an endless sprocket chain 40 passes. The chain 40 is driven from a suitable power take-off of the packaging machine.

Onto the opposite end of the drive shaft 30 from the sprocket wheel 38, and at the adjacent end of the shaft 28, there are keyed respective pairs of sprocket wheels 44 and 42 respectively around which two endless sprocket chains 46 pass. The said chains 46 have link plates 52 articulated to each other alternately by transverse pins 49 and by transverse link rods 48 which permit relative pivotal movement between adjacent link plates 52 of the two chains 46. Upon each link rod 48 there is fitted, between the two chains 46, a pair of guide rollers 50. Each rod 48 has a first free end 48*a* projecting beyond the outer chain 46, and upon this free end there is fitted a metal support 54 formed integrally with a movable shelf 26. The support 54 is connected to the rod 48 by a grub screw 56 screwed into the said support.

Each movable shelf 26 has a substantially L-shaped cross-section form, consisting of one flange 26*b* with a length greater than the height of each article 22, and one flange 26*a* with a length substantially equal to the length of the article 22, measured in the longitudinal feed direction of the said articles. Every movable shelf 26 has a number of parallel grooves 27 which extend over a substantial portion of the flange 26*b* and over the entire length of the flange 26*a*, so that the shelf 26 has a comb-like configuration (FIG. 3).

Each transverse link rod 48 has a second free end 48*b* extending beyond the inner chain 46. A crank arm 60 is fixed to the free end 48*b* of each rod 48 by means of a grub screw 58 screwed into the said arm 60. The crank arm 60 bears upon its free end a pin 62 which supports a freely rotatable guide roller 64 the axis of rotation of which is parallel to the axis of the link rod 48.

Figure 2:
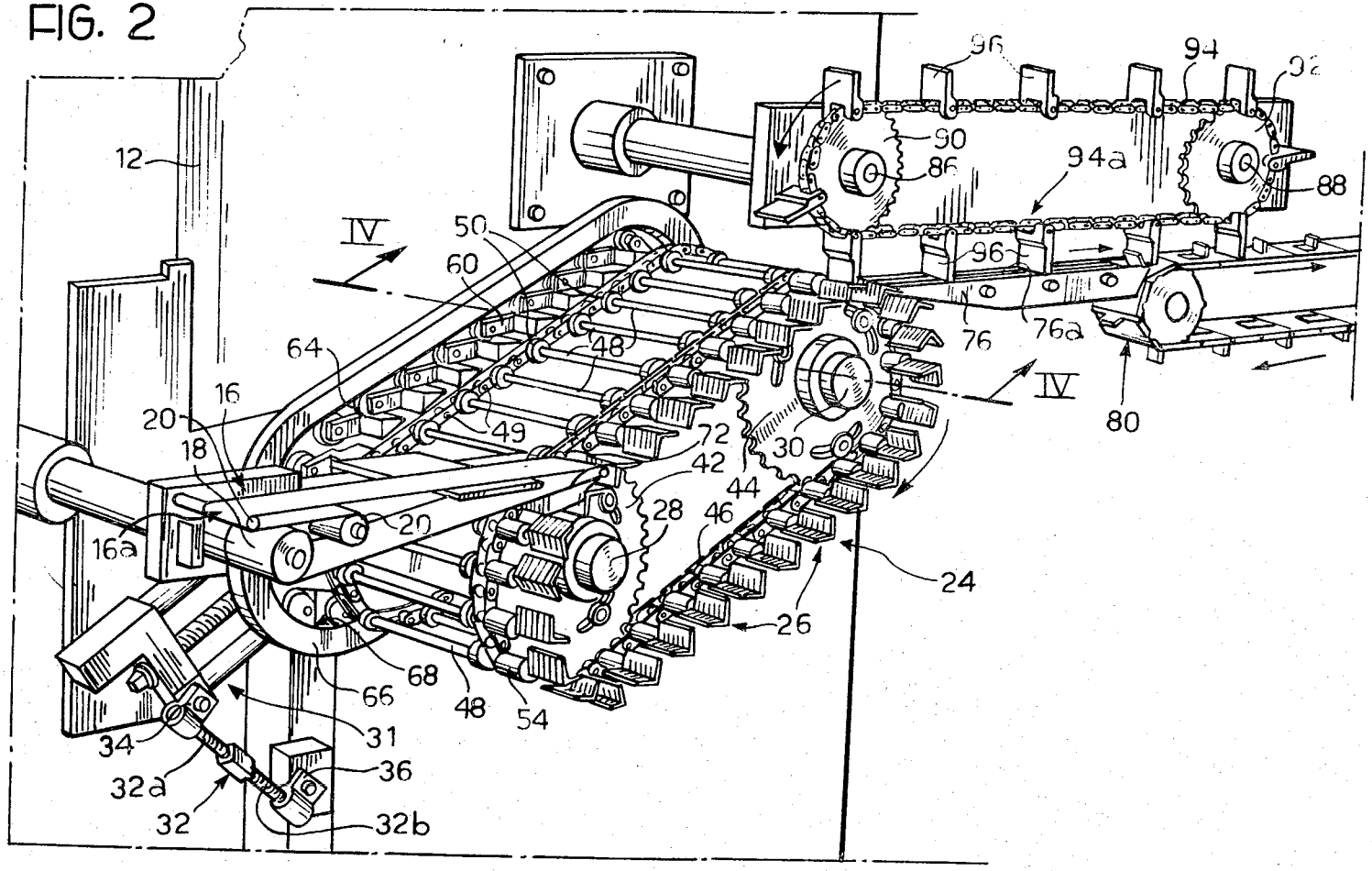
FIG. 2 is a partial perspective view of the apparatus shown in FIG. 1.

As can be seen in FIG. 2, there is affixed to the frame 31 a metal annular cam track 66 which has a substantially C shaped cross section. The cam track 66 acts as a desmodromic cam, in that the inner surfaces 68 of its channel (FIG. 4) define rolling tracks for the guide rollers 64. A flat guide member 70 extends along the operative ascending branch 24*a* of the conveyor 24. Upon the guide member 70 there roll the two guide rollers 50 of each link rod 48.

Figure 3:
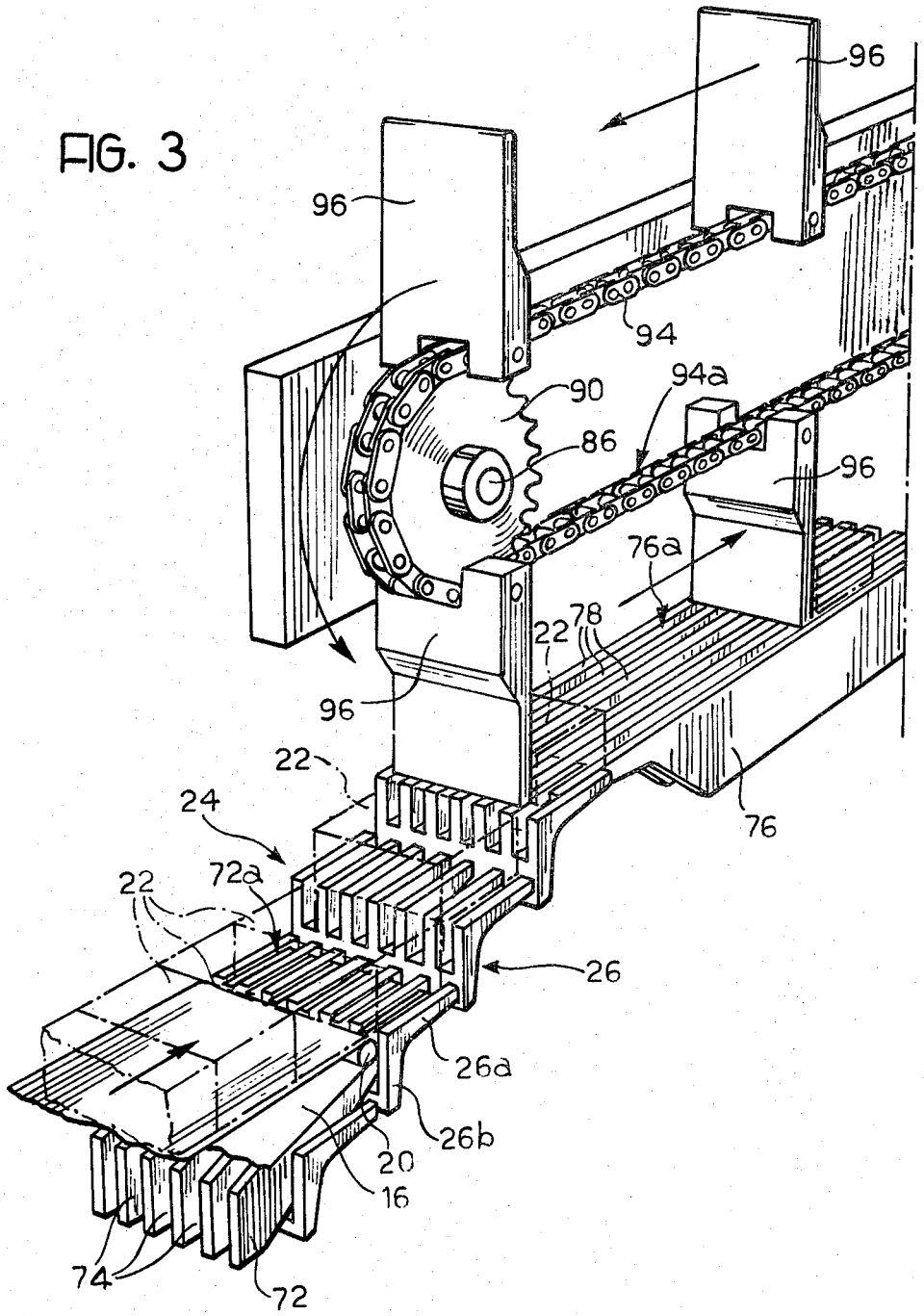
FIG. 3 is a perspective view of a detail of the apparatus shown in FIGS. 1 and 2.

The support structure 12 supports, cantilever fashion, two platforms 72 and 76 (FIG. 1) which, as shown in FIG. 3, are traversed by a number of parallel grooves 74 and 78, respectively so that the two platforms have a comb-like configuration. The platform 72 has an upper support surface 72*d* which is coplanar with the delivery end of the conveying run of the feed conveyor belt 16, the grooves 74 being staggered in relation to the grooves 27 of the moving shelves 26 so that the shelves 26 can pass through the grooves 27 in the first portion of the ascending run 24*a* of the elevator 24.

The cross-section of the inner walls 68 of the cam track 66 upon which the guide rollers 64 roll is so shaped that the flanges 26*a* of the moving shelves 26, upon which the articles 22 rest, move parallel to each other in the ascending run 24*a* of the elevator 24 from a lower, loading position in which the flange 26*a* is coplanar with the upper support surface 72*a* of the platform 72 and with the delivery end of the feed conveyor belt 16, to an upper delivery position in which the flange 26*a* is coplanar with an upper support surface 76*a* of the platform 76.

The platform 76, like the platform 72, is supported by the support structure 12 in such manner that its grooves 78 are staggered relative to the grooves 27 of the moving shelves 26, so that the latter can pass through the platform 76 when they reach the upper, delivery position.

A continuously driven endless chain conveyor 80, forming part of the packaging machine, is arranged with its delivery end adjacent to and coplanar with the platform 76.

A drive shaft 86 and a freely rotatable lay shaft 88 are supported by the support structure 12. The drive shaft 86 is driven via a chain transmission (not illustrated) from the drive shaft 30, so that it is kinematically connected to the packaging machine. Respective toothed sprocket wheels 90 and 92 are mounted on the shafts 86 and 88, and an endless sprocket chain 94 passes around the wheels 90 and 92. The two shafts 86 and 88 are arranged with their axes horizontal and parallel to each other, so that the lower horizontal run 94*a* of the chain 94 passes above, and parallel to, both the platform 76 and the conveying run of the conveyor 80 of the packaging machine. The sprocket chain 94 is provided with a number of transverse pallets 96 which are rigidly fixed to the chain and project perpendicularly from it at equal intervals along the chain 94.

Figure 5:
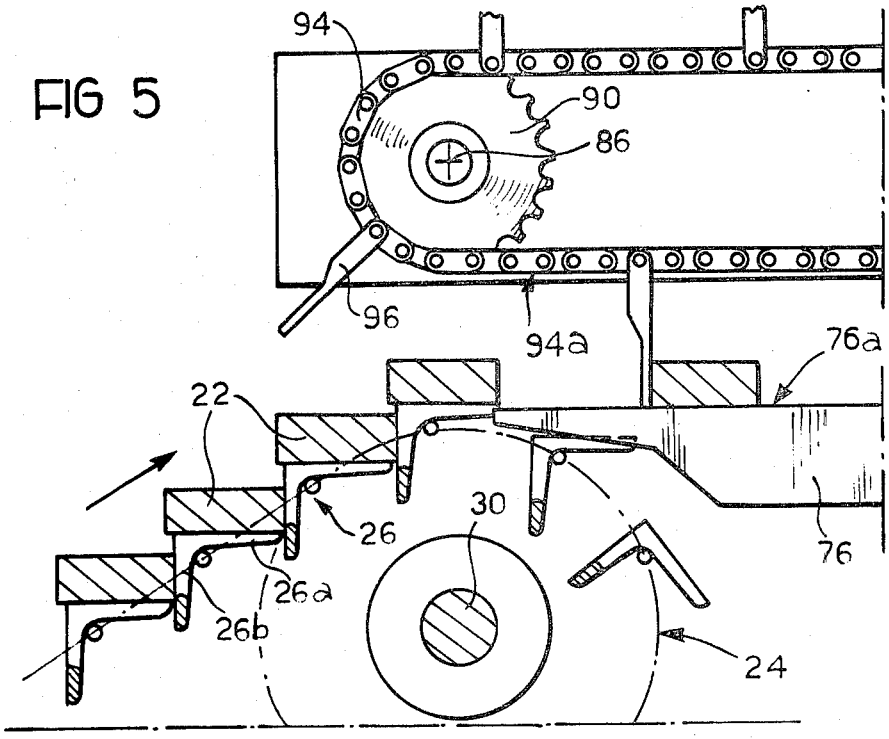
FIGS. 5 and 6 show diagrammatically two successive working stages of the apparatus.
Figure 6:
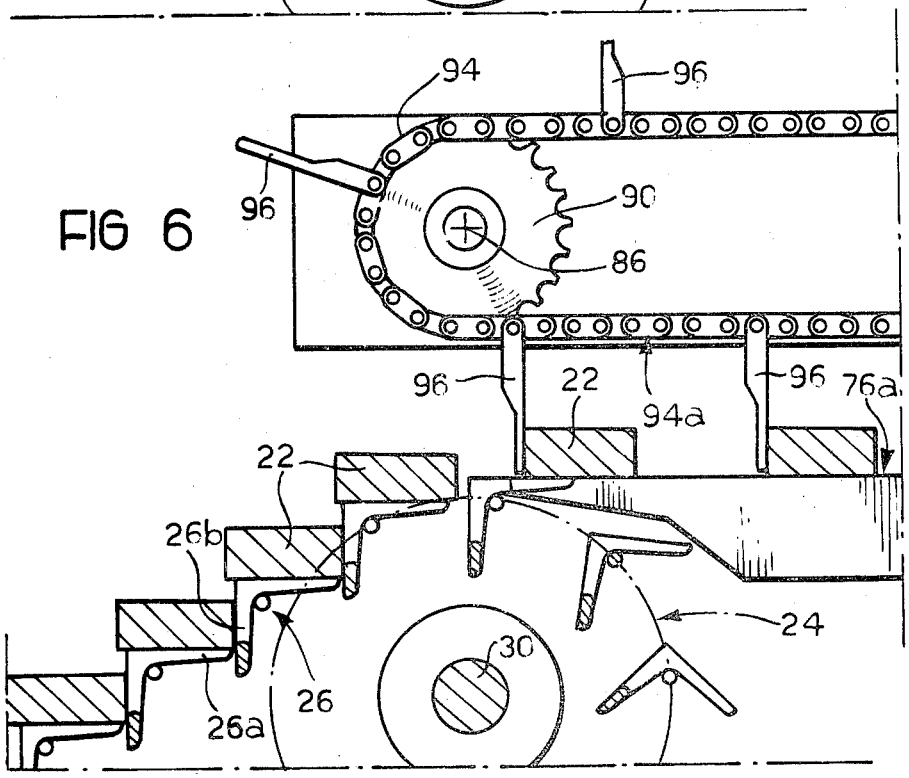

As can be seen in FIGS. 5 and 6, the axis of rotation of the drive shaft 86 substantially coincides vertically with the end of the platform 76 which is adjacent the elevator 24, so that each pallet 96 is disposed perpendicularly to and aligned with the said edge when it is at the start of its working movement along the operating run 94*a* of the chain 94. The height of each pallet 96 is such that its free edge during this working movement is close to the upper support surface 76*a* of the platform 76 and to the conveying run of the conveyor 80 of the packaging machine. The number of pallets 96, their mutual spacing and their speed of movement over the platform 76 are such that each time one of the moving shelves 26 of the elevator 24 reaches its upper delivery position coplanar with the platform 76 one of the pallets 96 will be situated at the start of its working movement, on the opposite side of the shelf 26 from the platform 76.

The feeder apparatus 10 described above operates as follows:

The articles 22 coming from the production plant, and arranged in a longitudinal row, are transferred to the conveyor belt 16 on which they are spaced apart in the direction of feed. The speed of the conveyor belt 16 is greater than the absorption capacity of the elevator 24, so that the article 22 which follows the first article in the row resting on the grooved platform 72 comes into contact with the first article, pushing the latter against the vertical flange 26b of the adjacent moving shelf 26 as shown in broken outline in FIG. 3. The next moving shelf 26, travelling at a uniform speed along the ascending run 24a of the elevator 24, collects the first article 22 from the row, lifting it from the aforesaid loading end of the elevator. During this movement the next following article 22 of the row is thrust by the following articles against the vertical flange 26b of the moving shelf 26, carrying the first article 22 up to where it rests entirely upon the grooved platform 72 and is thus ready to be lifted by the next following moving shelf 26.

When the moving shelf 26 carrying the first article 22 reaches its upper delivery position, then the article 22 is left resting upon the grooved platform 76, with an end face of the article 22 facing towards the elevator 24. As soon as it has reached this position one of the pallets 96 of the moving chain 94 will be in a vertical position at the start of its working movement (FIGS. 3 and 6) so that it sweeps the article 22 along the platform 76, transferring it from the platform 76 onto the chain conveyor 80 of the packaging machine. During the initial part of this movement the next moving shelf 26 of the elevator, carrying the second article 22, moves into the upper delivery position whilst the next following pallet 96 is completing its angular movement around the axis of rotation of the sprocket wheel 90 (FIG. 5) and is approaching the vertical position ready to engage the second article 22.

The stages described above are repeated for all the articles 22, which are thus fed individually to the packaging machine with a mutual spacing in the longitudinal direction of movement corresponding to that achieved by the chain conveyor 80 of the said machine.

Between the platform 76 and the chain conveyor 80 of the packaging machine there may additionally be inserted a continuously moving conveyor belt (not shown) to ensure continuous transfer of the articles swept by the pallets 96 from the platform 76 to the conveyor 80, which may be arranged transversely to the direction of movement of the articles along the platform 76.

It will be appreciated that other systems can be provided for feeding evenly spaced apart articles. Thus, for example, the feeder apparatus 10 could include a feeder for feeding to the packaging machine pairs of equidistantly spaced apart articles for example, for effecting multiple packaging. For this purpose the feed speed of the articles 22 from the feeder apparatus 10 would be double that of the chain conveyor 80 of the packaging machine so as to feed successive pairs of articles to a single conveyor station of the chain conveyor. Alternatively an intermediate stopping station may be interposed between the platform 76 and the chain conveyor 80 of the packaging machine so as to receive, for example, two successive articles from two successive pallets 96. In this case an auxiliary thrusting device such as, for example, a reciprocating pusher may be provided to transfer the pairs of articles for multiple packaging to the chain conveyor 80 of the packaging machine.

Where there is a requirement to feed the articles from the production plant in two or more longitudinal rows side by side the moving shelves 26 would have a width transversely of the feed direction such that each shelf holds a transverse row of articles, one from each of the longitudinal side-by-side rows. The feed apparatus according to the invention thus makes it possible to have successive transverse rows of delivered articles, equidistantly spaced apart by an amount proportional to the spacing imparted by the elevator. The packaging machine, or packaging machines, may, therefore, in this case be fed with the same number of longitudinal rows of articles which there were at the output of the production plant.

Where it is desired to use the feeder apparatus 10 for other articles slightly different from the articles 22, an adaptation of the elevator 24 may be effected by varying the inclination to the horizontal of its ascending run 24a. This is carried out by first rotating the threaded shaft 32 so as to move the frame 31 angularly about the axis of rotation of the drive shaft 30 and then adjusting the flanges 26a of the moving shelves 26 to the horizontal position in the ascending run 24a by orientating the shelf supports 54 and then clamping them in their new orientations by means of the grub screws 56.

The guide member 70 upon which the guide rollers 50 roll in the ascending run 24a of the elevator 24 ensures positive guiding of the moving shelves 26 during their ascent. Means of adjustment (not shown) are provided for adjusting the tension of the chains 52.

Figure 7:
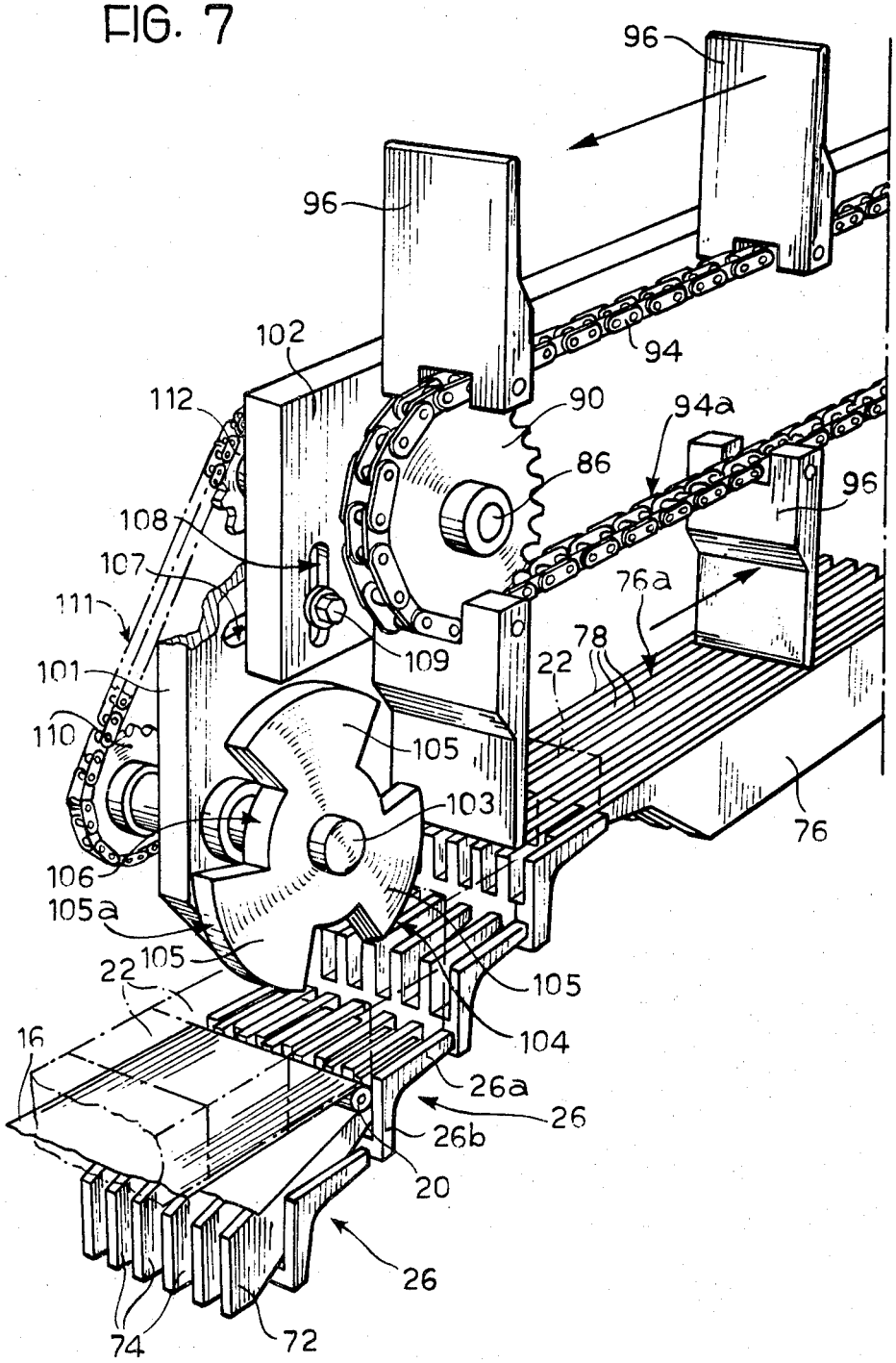
FIG. 7 is a partial perspective view of a first variant of the embodiment illustrated in FIGS. 1 to 6.
Figure 8:
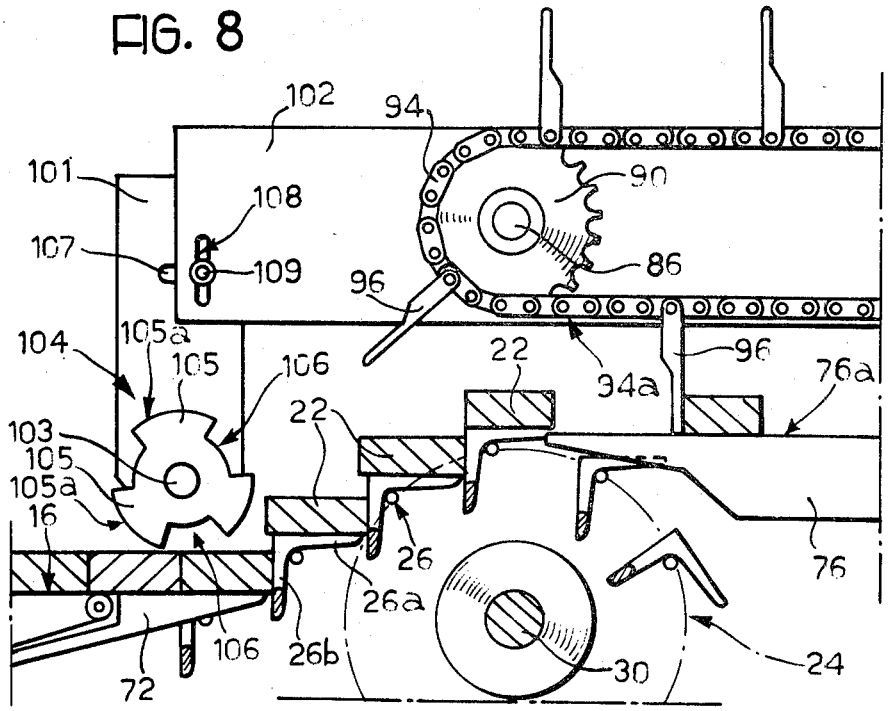
FIGS. 8 and 9 show diagrammatically two successive working stages of the apparatus of FIG. 7.
Figure 9:
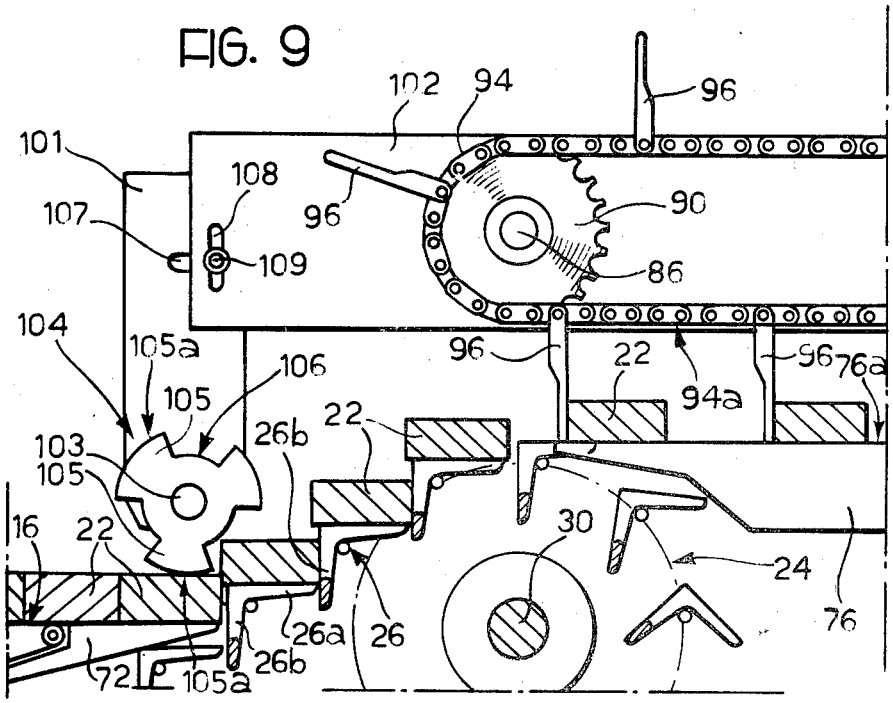

In the variant shown in FIGS. 7 to 9, the parts common to the apparatus illustrated in FIGS. 1 to 6 have been cross-referenced with the same reference numbers.

Reference numeral 101 indicates a cantilever-mounted plate fixed to a plate 102 of the support structure 12. The plate 102 supports the drive shaft 86 upon which the sprocket wheel 90 is mounted. The endless sprocket chain 94 passes around the sprocket wheel 90. The lower end of the plate 101 is situated above the platform 72 and supports a rotatable shaft 103, the axis of which is perpendicular to the longitudinal row of articles 22 which is fed on to the platform 72 by the feed belt 16. A rotor 104 is mounted on one of the ends of the shaft 103. The rotor 104 has three identical sector-shaped equiangularly spaced lobes 105 separated by notches 106. Each lobe 105 has an active peripheral edge 105a in the shape of the arc of a circle. The upper part of the plate 101 has a horizontal slot 107, and the plate 102 of the support structure 12 has a vertical slot 108. A bolt 109 passes through the slots 107 and 108 to clamp the plates 101 and 102 together. The axes of the slots 107 and 108 intersect, so that it is possible, by varying the position of the bolt 109 in the slots, to adjust the relative position of the plates 101 and 102. This relative position is so selected that the lowermost point of the active peripheral pressure edges 105a of the lobes 105 is spaced from the surface of the platform 72 by a distance substantially equal to the height of the articles 22.

A sprocket wheel 110 is fixed to the end of the shaft 103 opposite to the rotor 104. An endless transmission chain 111 passes around the sprocket wheel 110 and around a sprocket wheel 112 mounted on the end of the drive shaft 86 opposite the sprocket wheel 90. Since the drive shaft 86 is driven from the drive shaft 30 of the elevator 24, the shaft 103 is drivingly connected to the elevator 24. The transmission ratio of the chain 111 is selected so that the rotational speed of the rotor 104 results in each article 22 on the platform 72 passing beneath one of the lobes 105 of the rotor 104.

Under optimal operating conditions the peripheral edge 105a of each lobe 105 is spaced slightly from the upper surface of the article 22 beneath it so as not to interfere with the article. As shown in FIG. 9, when the article 22 is lifted from the platform 72 by one of the moving shelves 26 of the elevator 24, the notch 106 immediately following the lobe 105 under which the article 22 has passed allows the article to ascend on the ascending run 24*a* of the elevator 24. If the article 22, at the start of its ascent, should, by frictional contact with the immediately following article 22 which is on platform 72, tend to lift the latter article, the peripheral edge 105*a* of the lobe 105 which is above the said following article 22 restrains the latter and prevents it from rising. This avoids the possibility of the article 22, at the beginning of its ascent, lifting the immediately following article by friction and thereby displacing the article from its correct position.

The rotor 104 could of course have a different number of lobes 105 from those shown in the example. It suffices, for each type of rotor, to predetermine the transmission ratio of the chain 111 so as to ensure that each article 22 on the platform 72 passes under a respective lobe 105 of the rotating rotor 104.

Figure 10:
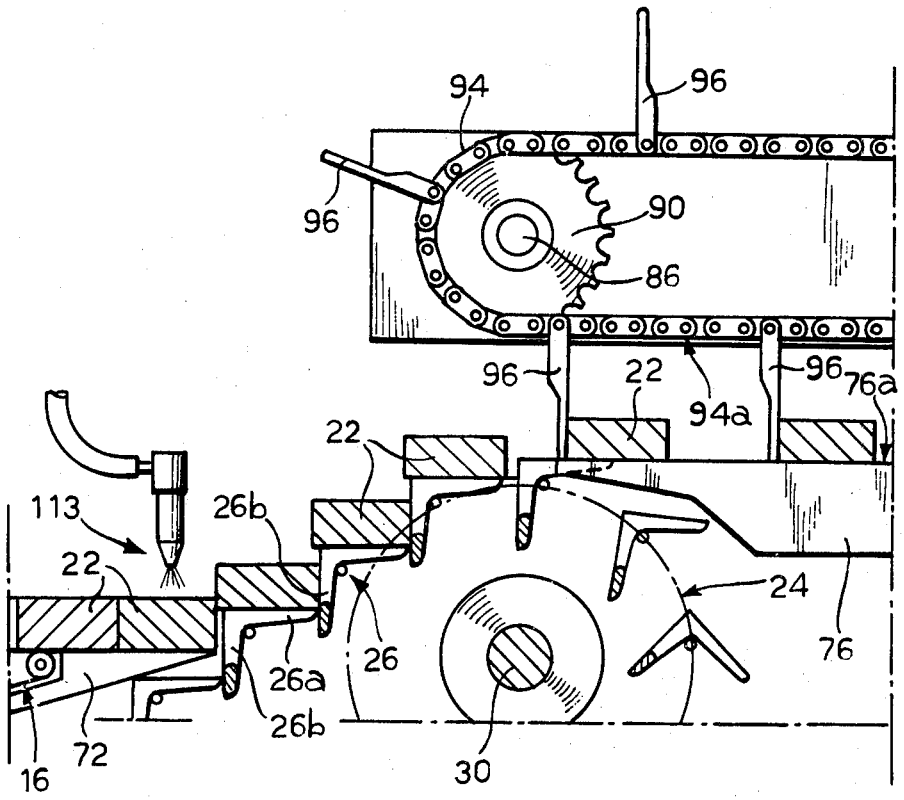
FIG. 10 is a partial diagrammatic view of a second variant of the embodiment illustrated in FIGS. 1 to 6.

When the feeder apparatus according to the invention is to be used for packaging particularly fragile products, or products of a very uneven shape, it might be advantageous to use the variant of the apparatus illustrated in FIG. 10. In this variant a jet 113 of compressed air, directed downwards through a nozzle, keeps each article 22 pressed down on the platform 72, thus preventing its being drawn upwards by frictional contact with the immediately downstream article as the latter is lifted from the platform 72 by one of the moving shelves 26 at the start of the ascent of the elevator 24.

What is claimed is:

1. Feeder apparatus for feeding articles such as sweetmeat products to a packaging machine, wherein the apparatus comprises in series:

a continuously driven feed conveyor belt arranged to receive at least one longitudinal row of articles from a production plant;

elevator means having shelves movable in the manner of an escalator continuously along a path which includes an ascending run and a decending run in the manner of an escalator, each shelf having a size corresponding to the size of the articles and having an upper comb-shaped support surface for the individual articles;

a fixed lower platform adjacent and coplanar with the delivery end of the feed conveyor belt;

an upper fixed platform, said lower and upper platforms having comb-like configurations staggered in relation to said comb-shaped support surfaces of the shelves so that the latter pass through said platforms, whereby each shelf in the ascending run of the elevator is displaced from a lower, loading, position in which it is coplanar with the lower platform to an upper, delivery, position in which it is coplanar with the upper platform;

ejecting means;

means operating the ejecting means in synchronism with the elevator, for removal of the articles as they are delivered to the upper platform;

a fixed support structure;

an upper horizontal drive shaft supported by the support structure;

a frame articulated to the support structure for movement angularly about the axis of rotation of the drive shaft;

adjusting means for adjusting the angular position of said frame;

a lower horizontal shaft freely rotatably supported by the same frame, each of said upper and lower shafts supporting a pair of sprocket wheels around which pass two chains, and support means carried by said chains and supporting respective said shelves of the elevator means in the ascending run of the latter.

2. Apparatus as defined in claim 1, wherein the frame adjustment means comprise a shaft having opposite ends which are threaded in opposite senses, and respective supports engaging the opposite ends of said shaft, said supports being pivotally connected to the support structure and to the frame respectively.

3. Apparatus as defined in claim 1 or claim 2, wherein each support means for each moving shelf comprises a link rod which extends transversely between transversely opposed links of the two chains and affords a pivotal connection between adjacent links of the chains, each rod having opposite ends projecting beyond the said chains and a respective shelf support adjustably affixed to one of said ends, the opposite end bearing a guide roller, and including a cam track on which the guide rollers move, the cam track being carried by the frame and so arranged as to keep the upper support surface of each shelf horizontal in its movement along the ascending run of the elevator means.

4. Feeder apparatus for feeding articles such as sweetmeat products to a packaging machine, wherein the apparatus comprises in series:

a continuously driven feed conveyor belt arranged to receive at least one longitudinal row of articles from a production plant, elevator means having shelves movable in the manner of an escalator continuously along a path which includes an ascending run and a descending run in the manner of an escalator, each shelf having a size corresponding to the size of the articles and having an upper comb-shaped support surface for the individual articles, a fixed lower platform adjacent and coplanar with the delivery end of the feed conveyor belt, an upper fixed platform, said lower and upper platforms having comb-like configurations staggered in relation to said comb-shaped support surfaces of the shelves so that the latter pass through said platforms, whereby each shelf in the ascending run of the elevator is displaced from a lower, loading, position in which it is coplanar with the lower platform to an upper, delivery, position in which it is coplanar with the upper platform, ejecting means, means operating the ejecting means in synchronism with the elevator, for removal of the articles as they are delivered to the upper platform; and pressure means arranged above the lower platform and adapted to keep each article on the surface of said lower platform before it is lifted by one of the moving shelves of the elevator means; said pressure means comprise a rotor rotatable about an axis perpendicular to the longitudinal row of articles, transmission means connected to the elevator means for driving the rotor, said rotor having a plurality of active peripheral portions, identical to each other, which at their lowest point are spaced from the lower fixed platform by a distance substantially equal to the height of the articles fed over said platform and each of which acts upon a single article on the lower platform and is separated from the adjacent active peripheral portions by rotor notches which allow unimpeded ascent of the immediately preceding article on an ascending said shelf of the elevator means in use of the apparatus.

5. Apparatus as defined in claim 4, including means supporting said rotor for adjustment of the axis of the rotor vertically relative to the lower platform and longitudinally in the lengthwise direction of the articles.

* * * * *